US006349703B1

(12) United States Patent
Rapp

(10) Patent No.: US 6,349,703 B1
(45) Date of Patent: Feb. 26, 2002

(54) PRESSURE REGULATING VALVE FOR A STORAGE-TYPE FUEL INJECTION SYSTEM FOR INTERNAL COMBUSTION ENGINES

(75) Inventor: Holger Rapp, Hemmingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/688,114

(22) Filed: Oct. 16, 2000

(30) Foreign Application Priority Data

Oct. 15, 1999 (DE) ..... 199 49 814

(51) Int. Cl.[7] ..... F02M 41/00
(52) U.S. Cl. ..... 123/458; 123/514; 251/129.15
(58) Field of Search ..... 123/447, 506, 123/458, 456, 514; 251/129.15, 129.16, 50, 129.18

(56) References Cited

U.S. PATENT DOCUMENTS 5,056,556 A * 10/1991 Nishimoto et al. ..... 137/522
5,067,688 A * 11/1991 Tanimoto et al. ..... 251/129.18
5,456,233 A * 10/1995 Felhofer ..... 123/447
5,462,253 A * 10/1995 Asthana et al. ..... 251/121
5,970,958 A * 10/1999 DeLand et al. ..... 123/520
6,076,504 A * 6/2000 Stavnheim et al. ..... 123/447
6,131,829 A * 10/2000 Ricco
6,152,387 A * 11/2000 Ricco ..... 239/585.1
6,161,813 A * 12/2000 Baumgartner et al. ..... 251/50

* cited by examiner

*Primary Examiner*—Carl S. Miller
(74) *Attorney, Agent, or Firm*—Ronald E. Greigg

(57) ABSTRACT

A pressure regulating valve that is used to regulate the pressure in a fuel reservoir and has a valve body in which a pistonlike valve member is disposed axially displaceably in a bore counter to the force of a closing spring. The valve member forms an armature of an electromagnet, which is supplied with current to reinforce the closing force of the closing spring. The valve member acts on a closing element, which is pressed against a valve seat by the force of the closing spring and the magnetic force and which is acted upon on an other end by the pressure in the fuel reservoir. The valve member has two axially offset guide portions, which are embodied as short cylinder portions and have a diameter that is only slightly smaller than the diameter of the bore. By way of its guide portions, the valve member is guided displaceably with defined contact in the bore.

2 Claims, 1 Drawing Sheet

Fig. 1
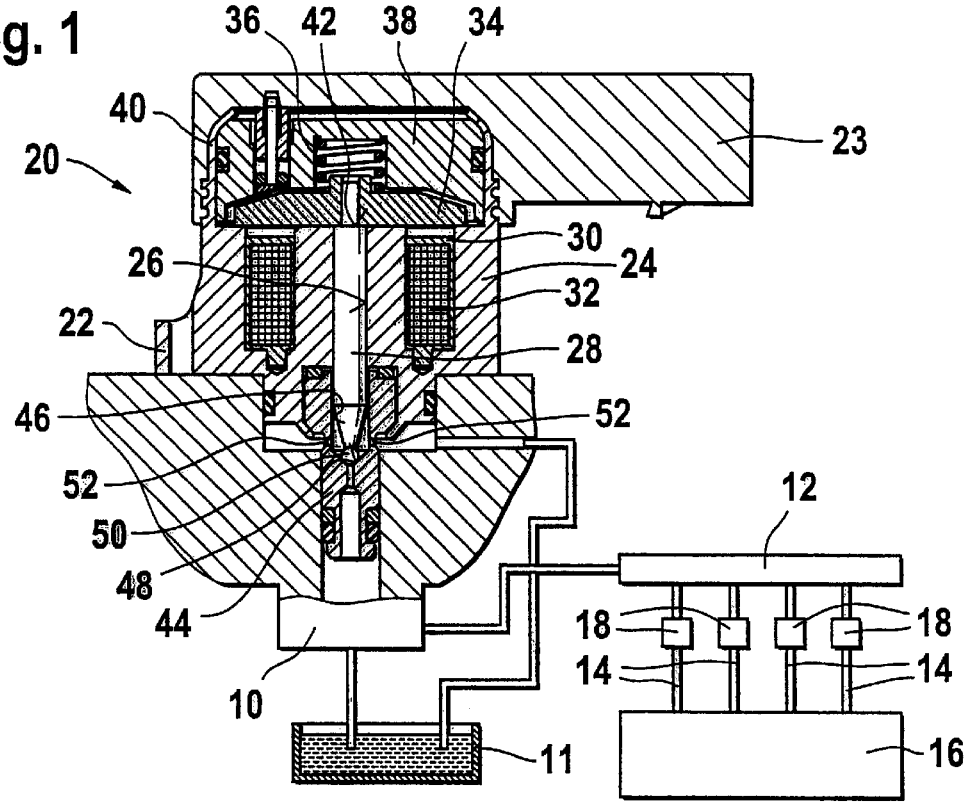
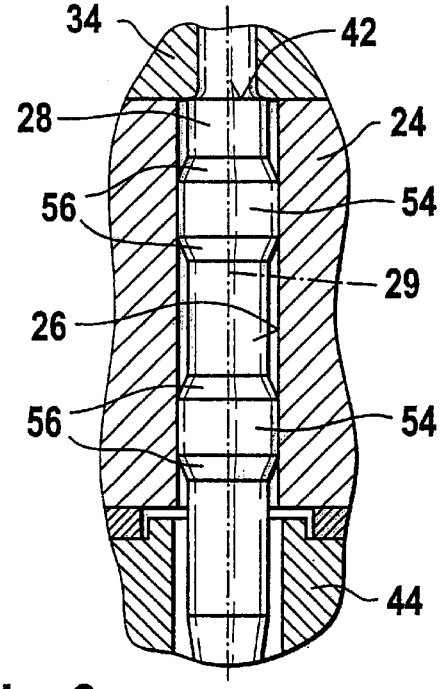
Fig. 2
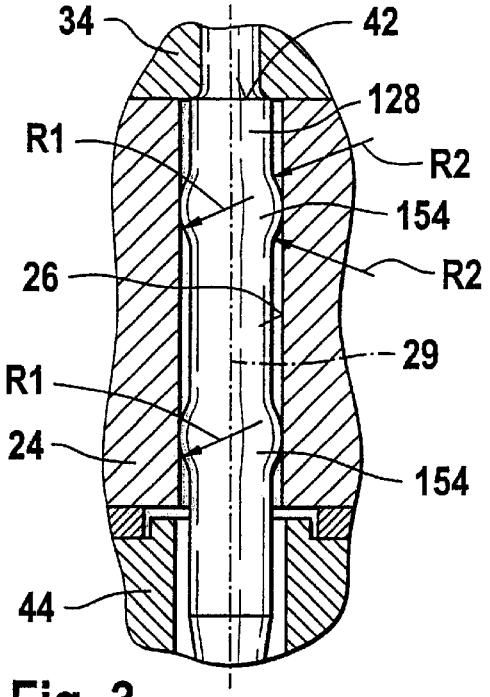
Fig. 3

PRESSURE REGULATING VALVE FOR A STORAGE-TYPE FUEL INJECTION SYSTEM FOR INTERNAL COMBUSTION ENGINES

FIELD OF THE INVENTION

The invention is based on a pressure regulating valve for a storage-type fuel injection system for internal combustion engines.

BACKGROUND OF THE INVENTION

A pressure regulating valve of this kind is known from the literature, such as the textbook *Dieselmotor-Management* [Diesel Engine Management], second edition, Verlag Vieweg, 1998, pages 270, 271. This pressure regulating valve is used to regulate the pressure in a fuel reservoir. The pressure regulating valve has a pistonlike valve member, guided axially displaceably in a bore counter to the force of a closing spring. The valve member acts in the closing direction on a closing element of the pressure regulating valve and presses the valve against a valve seat. The valve member forms an armature of an electromagnet, which can be supplied with current to reinforce the force of the closing spring. By means of the closing spring, via the valve member, the closing element is pressed with a certain force against the valve seat, and as a result of the pressure acting on the closing element, the closing element is lifted from the valve seat in the fuel reservoir when the force generated by the pressure exceeds the force of the closing spring, and fuel flows out of the fuel reservoir via the open pressure regulating valve into a relief chamber. To establish a higher pressure in the fuel reservoir, current is supplied to the electromagnet, so that the closing force exerted on the closing element via the valve member is increased, and thus it is not until there is a higher pressure in the fuel reservoir that the closing element lifts from the valve seat and causes fuel to flow out of the fuel reservoir into the relief chamber. The valve member has a relatively great length and is cylindrical, and because of dimensional and positional tolerances of the valve member and the bore it is difficult to achieve a defined guidance and contact of the valve member in the bore over its entire length. An undefined contact of the valve member in the bore, a skewed position of the valve member above all with electromagnets that are supplied with current, and as a result increased friction between the valve member and the bore can thus all occur. This in turn can lead to a functional impairment of the pressure regulating valve, and in particular fast movements of the valve member are impaired, thus precluding exact establishment of the pressure in the fuel reservoir.

OBJECT AND SUMMARY OF THE INVENTION

The pressure regulating valve according to the invention has an advantage over the prior art that the valve member is guided in a defined way in the bore via its guide portions, and the functional reliability of the pressure regulating valve is thus improved.

Advantageous features and refinements of the pressure regulating valve of the invention are disclosed hereinafter. Canting of the valve member in the bore is averted by an embodiment of the invention.

The invention will be better understood and further objects and advantages thereof will become more apparent from the ensuing detailed description of a preferred embodiment taken in conjunction with the drawing.

BRIEF DESCRIPTION OF THE DRAWING

FIG. 1 is a longitudinal section through a pressure regulating valve;

FIG. 2, on a larger scale, shows a valve member of the pressure regulating valve in a first exemplary embodiment; and FIG. 3 shows the valve member in a second exemplary embodiment.

DESCRIPTION OF THE PREFERRED EMBODIMENTS

FIG. 1 in fragmentary form shows a storage-type fuel injection system for internal combustion engines, in particular self-igniting internal combustion engines. The storage-type fuel injection system, which is also known as a common rail injection system, has a high- pressure pump 10, through which fuel is pumped under high pressure out of a fuel tank 11 into a fuel reservoir 12. The fuel reservoir 12 is embodied in tubular fashion, as a so-called rail, for instance. From the fuel reservoir 12, lines 14 lead away to the injection locations at the engine 16, at each of which there is an injection valve 18. For adjusting the pressure in the fuel reservoir 12, a pressure regulating valve 20 is provided, which can be provided either at the outlet of the high-pressure pump 10 or at the fuel reservoir 12.

The pressure regulating valve 20 has a valve body 24, in which a bore 26 is formed in which a pistonlike valve member 28 is guided axially displaceably; the valve member will be described in further detail hereinafter. A fastening flange 22 is embodied on the valve body 24, and by way of this flange the valve body is secured to the high-pressure pump 10 or to the fuel reservoir 12. The valve body 24 has an annular chamber 30, which axially surrounds the bore 26 and in which an electromagnet 32 is disposed with a coil winding. A connection element 23 which serves the purpose of electrically contacting the electromagnet 32 is slipped onto the valve body 24. On the side of the valve body 24 toward the connection element 23, there is a spring plate 34, which covers the annular chamber 30 and on whose side remote from the annular chamber 30 a prestressed spring 36, embodied for instance as a helical compression spring, is braced. On its other side, the spring 36 is braced on a cap 38, connected to the valve body 24, that is inserted into a hollow- cylindrical extension 40 of the valve body 24. The extension 40 of the valve body 24 has a larger cross section than the annular chamber 30, and the cap 38 can be retained in the valve body 24, for instance by crimping the extension 40 over the cap. The valve member 28 protrudes from the bore 26 into the extension 40, and at that point the valve member has a reduced diameter, forming an annular shoulder 42 on the valve member 28. The valve member 28 protrudes by an end into a bore of the spring plate 34, which is axially braced on the annular shoulder 42 of the valve member 28.

In its end region opposite the extension 40, the bore 26 has an increased diameter, into a portion a valve insert 44 is inserted. The valve insert 44 can be retained in the valve body 24 by way of example, by crimping a protruding edge of the valve body 42 over the valve insert 44. The valve insert 44 has a bore 46, which is at least approximately coaxial with the bore 26 of the valve body 28 and into which the end portion of the valve member 28, which can for instance taper conically, protrudes. The diameter of the bore 46 in the valve insert 44 decreases in the direction away from the valve member 28, and at the transition in the bore 46 to its smaller diameter, a valve seat 48 is formed, which for instance can be embodied somewhat conically. Downstream of the portion adjoining the valve seat 48, the bore 46 again has a larger diameter. A closing element 50, for instance in the form of a ball, which cooperates with the valve seat 48, is disposed in the valve insert 44. In the region where the end region of the valve member 28 protrudes into its bore 46, the valve insert 44 has one or more openings 52, through which the bore 46 communicates with the surroundings of the valve insert 44.

The valve member 28 is shown enlarged in a first exemplary embodiment in FIG. 2. The valve member 28 is formed for instance of steel and forms an armature of the electromagnet 32. As already described above, on its upper end region in terms of FIGS. 1 and 2, the valve member has a smaller diameter, thus forming the annular shoulder 42 on which the spring plate 34 is supported. In its region disposed in the bore 26, the valve member 28 has a plurality of guide portions 54, preferably two of them, offset axially from one another, which have a diameter that is only slightly smaller than the diameter of the bore, so that the guide portions 54 are disposed with only slight radial play in the bore 26, and the valve member 28 is guided displaceably in the bore via its guide portions 54. The guide portions 54 are embodied as short cylinder portions, and in axial longitudinal sections, that is, longitudinal sections that contain the longitudinal axis 29 of the valve member 28, they have straight jacket lines extending parallel to the longitudinal axis 29 of the valve member 28. Outside the guide portions 54, the diameter of the valve member 28 is less than at the guide portions 54 and is markedly less than the diameter of the bore 26, so that no contact of the valve member 28 with the bore 26 exists there. The transition between the guide portions 54 and the remaining regions of the valve member 28 can be made, for instance as shown in FIG. 2, by somewhat conically extending transitional portions 56. The valve member 28 can be made by turning on a lathe, for instance.

In FIG. 3, the valve member 128 in accordance with a second exemplary embodiment is shown. The valve member 128 is again of steel and forms an armature of the electromagnet 32. In its region disposed in the bore 26, the valve member 128 has a plurality of guide portions 154, preferably two of them, axially offset from one another. Once again, the guide portions 154 have a diameter that is only slightly less than the diameter of the bore, so that the guide portions 154 are disposed with slight radial play in the bore 26, and the valve member 128 is guided displaceably in the bore 26 via its guide portions 154. The guide portions 154 are embodied spherically and have convexly curved jacket lines in axial longitudinal sections. The jacket lines of the guide portions 154 can be embodied at least approximately as portions of a circle of a radius R1. The transitions between the guide portions 154 and the remaining regions of the valve member 128 can be rounded, with jacket lines curved in concave fashion in axial longitudinal sections, the jacket lines being embodied at least approximately as portions of a circle of a radius R2, for instance. The valve member 128 can be made by turning on a lathe or by rolling. Canting of the valve member 128 in the bore 26 is averted with certainty by means of the rounded guide portions 154.

The function of the pressure regulating valve 20 will now be explained. When there is no current to the electromagnet 32, the valve member 28 or 128 is pressed by the spring 36, which forms a closing spring, into the valve insert 44; with its face end, the valve member 28, 128 contacts the closing element 50 and presses the closing element against the valve seat 48. The closing element 50 is acted upon by the pressure on the outlet side of the high-pressure pump 10, or the pressure in the fuel reservoir 12, which generates a force on the closing element 50 that counteracts the force of the closing spring 36. If the force generated by the pressure is greater than the force of the closing spring 36, the closing element 50 is lifted from the valve seat 48 and is displaced together with the valve member 28, 128 and the spring plate 34. With the pressure regulating valve 20 open, fuel flows out of the fuel reservoir 12 through the bore 46, valve seat 48 and openings 52 in the valve insert 44, into a relief chamber, for instance the fuel tank 11. When there is no current to the electromagnet 32, the pressure regulating valve 20 already opens at a relatively slight pressure in the fuel reservoir, and this pressure is determined by the force of the closing spring 36. If the pressure in the fuel reservoir 12 is to be increased, then current is supplied to the electromagnet 32, so that the valve member 28, 128 is urged in the closing direction not only by the force of the closing spring 36 but also by the magnetic force acting on the valve member and presses the closing element 50 against the valve seat 48. If the force exerted on the closing element 50 by the pressure in the fuel reservoir 12 is greater than the force of the closing spring 36 and the magnetic force on the valve member 28, 128, then the pressure regulating valve 20 opens, and it remains in its open position and keeps the pressure in the fuel reservoir 12 constant. An altered supply quantity of the high-pressure pump 10 or a withdrawal of fuel from the fuel reservoir 12 upon the injection of fuel into the engine 16 is compensated for by the pressure regulating valve 20 by opening in a variable way. The magnetic force exerted by the electromagnet 32 on the valve member 28 or 128 is dependent on the current that flows through the electromagnet 32, which for instance has a characteristic curve that rises monotonically. The supply of current to the electromagnet 32 is determined by a control unit, which is supplied with signals regarding various operating parameters of the engine 16 and which adjusts the current intensity for the electromagnet 32 in such a way that the requisite pressure in the fuel reservoir 12 for the operating state of the engine 16 at the time is established. The current intensity for the electromagnet 32 can be varied for instance by clocking the supply of current, for instance with pulse width modulation.

The foregoing relates to a preferred exemplary embodiments of the invention, it being understood that other variants and embodiments thereof are possible within the spirit and scope of the invention, the latter being defined by the appended claims.

I claim:

1. A pressure regulating valve for a storage-type fuel injection system for internal combustion engines for regulating the pressure in a fuel reservoir (12), comprising a pistonlike valve member (128), guided axially displaceably in a bore (26) counter to a force of a closing spring (36), the valve member acts in the closing direction on a closing element (50) and presses the closing element against a valve seat (48), and the valve member (128) forms an armature of an electromagnet (32), the electromagnet can be supplied with current to reinforce the closing force of the closing spring (36), in that the valve member (128) has guide portions (154) which are embodied spherically, with jacket lines curved convexly in axial longitudinal sections and are offset from one another axially, by way of which the valve member is guided in the bore (26), and that the valve member (128) has a smaller cross section outside the guide portions (154) than in the region of the guide portions (154).

2. The pressure regulating valve according to claim 1, in which the valve member (128) has two guided portions (154).

* * * * *